US007107640B2

(12) United States Patent
Chapman et al.

(10) Patent No.: US 7,107,640 B2
(45) Date of Patent: Sep. 19, 2006

(54) INFLATABLE SUPPORT

(75) Inventors: Paul William Chapman, Bedfordshire (GB); Clive Russell Perry, Bedfordshire (GB)

(73) Assignee: Huntleigh Technology, PLC, Bedfordshire (GB)

( * ) Notice: Subject to any disclaimer, the term of this patent is extended or adjusted under 35 U.S.C. 154(b) by 0 days.

(21) Appl. No.: 09/980,284

(22) PCT Filed: Apr. 4, 2001

(86) PCT No.: PCT/GB01/01515

§ 371 (c)(1),
(2), (4) Date: Feb. 21, 2002

(87) PCT Pub. No.: WO01/74287

PCT Pub. Date: Oct. 11, 2001

(65) Prior Publication Data

US 2002/0133882 A1 Sep. 26, 2002

(30) Foreign Application Priority Data

Apr. 5, 2000 (GB) ..... 0008399.8

(51) Int. Cl.
*A47C 27/10* (2006.01)

(52) U.S. Cl. ..... 5/710; 5/713; 5/715; 5/739

(58) Field of Classification Search ..... 5/709, 5/710, 713, 715, 739; 128/895
See application file for complete search history.

(56) References Cited

U.S. PATENT DOCUMENTS

| | | | | |
|---|---|---|---|---|
| 1,576,211 | A * | 3/1926 | O'Kane | 5/710 |
| 1,772,310 | A | 8/1930 | Hart | |
| 2,328,083 | A * | 8/1943 | Lineback | 5/709 |
| 3,978,530 | A | 9/1976 | Amarantos | |
| 4,225,989 | A | 10/1980 | Corbett et al. | |
| 4,428,087 | A | 1/1984 | Horn | |
| 4,639,960 | A | 2/1987 | Quillen et al. | |
| 4,941,221 | A | 7/1990 | Kanzler | |
| 5,109,561 | A | 5/1992 | Schild | |
| 5,611,096 | A | 3/1997 | Bartlett et al. | |
| 5,651,151 | A | 7/1997 | Schild | |
| 5,765,246 | A | 6/1998 | Shoenhair | |
| 5,774,917 | A | 7/1998 | Liu et al. | |
| 6,058,538 | A | 5/2000 | Chapman et al. | |
| 6,079,070 | A * | 6/2000 | Flick | 5/715 |
| 6,085,372 | A * | 7/2000 | James et al. | 5/713 |
| 6,134,732 | A | 10/2000 | Chapman et al. | |
| 6,148,461 | A | 11/2000 | Cook et al. | |
| 6,240,584 | B1 * | 6/2001 | Perez et al. | 5/713 |
| 6,349,437 | B1 | 2/2002 | Horning | |

FOREIGN PATENT DOCUMENTS

| | | |
|---|---|---|
| BE | 840371 | 8/1976 |
| GB | 2 267 217 | 12/1993 |

(Continued)

*Primary Examiner*—Michael Trettel
(74) *Attorney, Agent, or Firm*—Brown Raysman, Millstein, Felder & Steiner

(57) ABSTRACT

An alternating pad consisting of transverse inflatable cells (1 and 2) alternately inflated and deflated. An internal cell (5) is provided at the outermost edges of each transverse cell (1,2). The internal cell (5) is constantly inflated at a higher pressure than the traverse cells (1, 2). The internal cell (5) is at a lower height than the cells (1,2) and preferably of a chamfered shape to provide optimum pressure relief across the whole surface of the pad. The internal cell (5) provides stable patient exit, entry or transfer from a bed or seat.

8 Claims, 2 Drawing Sheets

FOREIGN PATENT DOCUMENTS

| | | |
|---|---|---|
| GB | 2 319 721 A | 6/1998 |
| GB | 2 320 892 A | 7/1998 |
| WO | WO 90/07317 | 7/1990 |
| WO | WO 95/21599 | 8/1995 |
| WO | WO 97/17869 | 6/1997 |

* cited by examiner

INFLATABLE SUPPORT

This application is a national phase entry of PCT application PCT/GB01/01515, filed 4 Apr. 2001, which claims benefit of Great Britain patent application 0008399.8, filed 5 Apr. 2000.

FIELD OF THE INVENTION

The invention relates generally to an inflatable support and more particularly to a pressure pad, alternating pad, or cushion for providing increased safety for patients, and for the prevention of conditions such as decubitous ulcers.

BACKGROUND OF THE INVENTION

In recent years, inflatable supports have come into extensive use and are used widely in hospitals to prevent and treat decubitus ulcers which are commonly referred to as bed sores. A primary cause of bed sores is the inability of the patient to move so as to relieve pressure points. These pressure points typically occur in the area of a bony protuberance which results in a cut-off of the blood flow in the skin and soft tissue adjacent to the protuberance when distortion of capillary beds curtails blood flow. When the blood flow in the capillaries is blocked due to excessive external interface pressure, the cells in that area begin to die and may result in a wound which is called a bed sore. Mobile persons do not have this problem because they continually move even when asleep which eliminates the cut-off of blood flow for too long a period.

A typical inflatable support system for the prevention of bed sores has a plurality of parallel cells alternately inflated to provide support for the user.

The inflatable support system may comprise an alternating pad or mattress for a bed or similar system for a seat.

It has been found that with such inflatable support systems that users are at risk of falling, particularly when getting onto and off from the bed or seat.

In order to provide easier user entry, exit or transfer and prevent the user falling out with such an inflatable support, it is known to have two inflatable side chambers extending lengthwise of the support and each connected to receive air under pressure from a source. The source also supplies air under pressure to a plurality of side-by-side alternately inflated air tubes extending laterally of the mattress and between the two side chambers, the arrangement being such that, when inflated, the upper surface of each side chamber lies at or above the upper surface of the air tubes.

However, the above arrangement provides for increased interface pressure at the surface of the side chambers and has resulted in pressure sores occurring on the user at the elbows and heels. Also, the side chambers increase the height of the support making it difficult for some users to physically get onto the support.

SUMMARY OF THE INVENTION

The present invention provides an improved inflatable support having stable user entry, exit or transfer from a bed or seat but also providing improved pressure relief over the whole surface area of the support.

According to the invention, an inflatable support for providing pressure relief, comprising at least one inflatable cell extending transversely of the support, the one or more transverse cell(s) having within each of their outermost opposite ends, internal cells at a higher pressure than the transverse cell(s), the internal cells having a lower height than the transverse cells, such that the whole of the support surface provides pressure relief. By arranging for the height of the internal cell to be smaller than the transverse cell, the pressure relief is not compromised by ensuring that the area enjoying pressure relief is the whole surface of the support. Further, the internal cells provide improved stability of the support edge, so that a user is prevented from falling out and has a firmer edge for entry, exit and transfer.

Preferably, there are provided a plurality of transverse cells inflated and deflated alternately.

More preferably, the internal cells are constantly inflated. To provide a better comfort for the user lying thereon and better pressure relief, the internal cells are chamfered at their internal edges. More preferably, the internal cells are filled with foam or similar material.

Preferably, the internal cells at each opposite end of the transverse cell are connected by a common manifold and inflated jointly by that manifold. Additionally, the manifold is of foam.

BRIEF DESCRIPTION OF THE DRAWINGS

The invention will now be described by way of example only with reference to the accompanying figures in which.

DETAILED DESCRIPTION OF THE PREFERRED EMBODIMENTS

Figure 1:
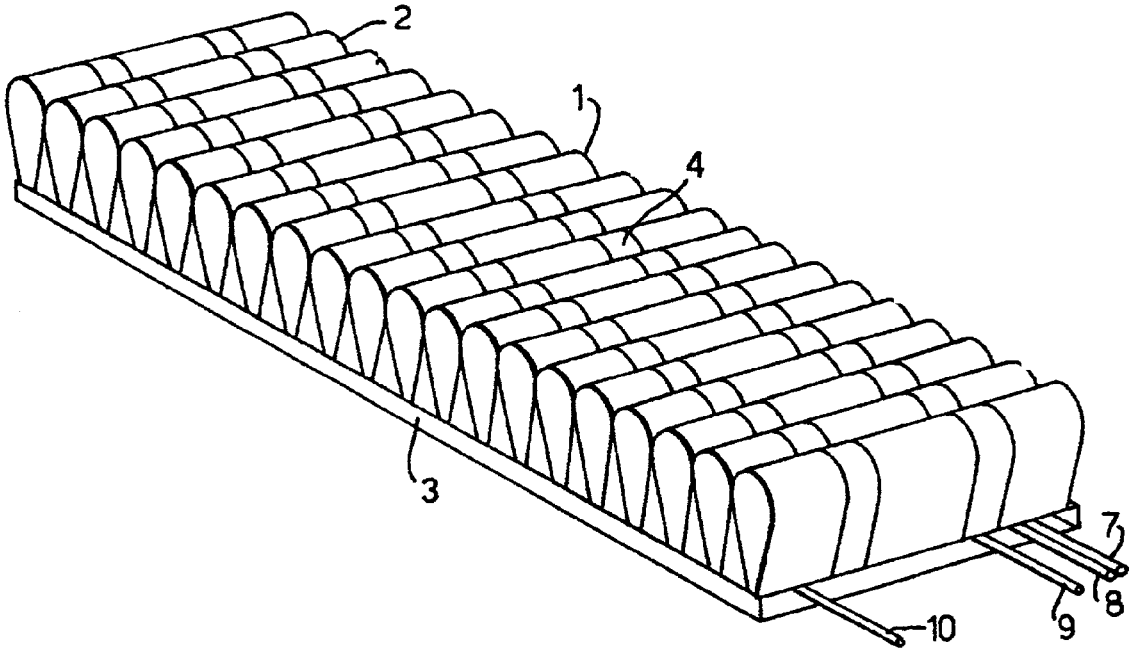
FIG. 1 is a schematic view of a pressure pad according to the invention.

Referring to FIG. 1, a first set of inflatable cells 1 and a second set of inflatable cells 2 are shown, the first set being fully inflated and the second set fully deflated. The two sets are alternately inflatable and are supplied with air from a compressor (not shown). The first and second sets are supplied air from respective feed lines 7 and 8.

Figure 2:
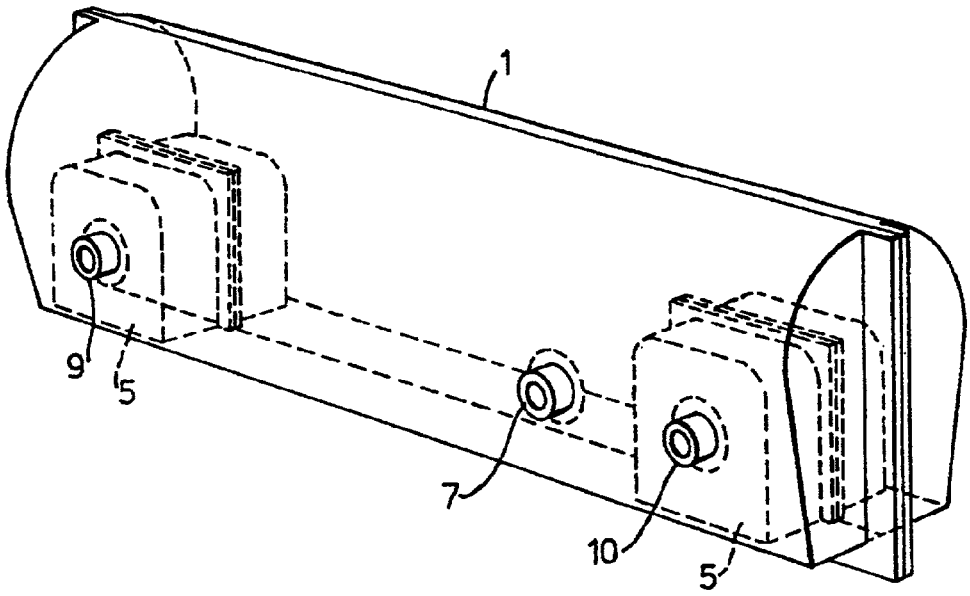
FIG. 2 is a cross-sectional representation of the pressure pad showing the internal cells.
Figure 3:
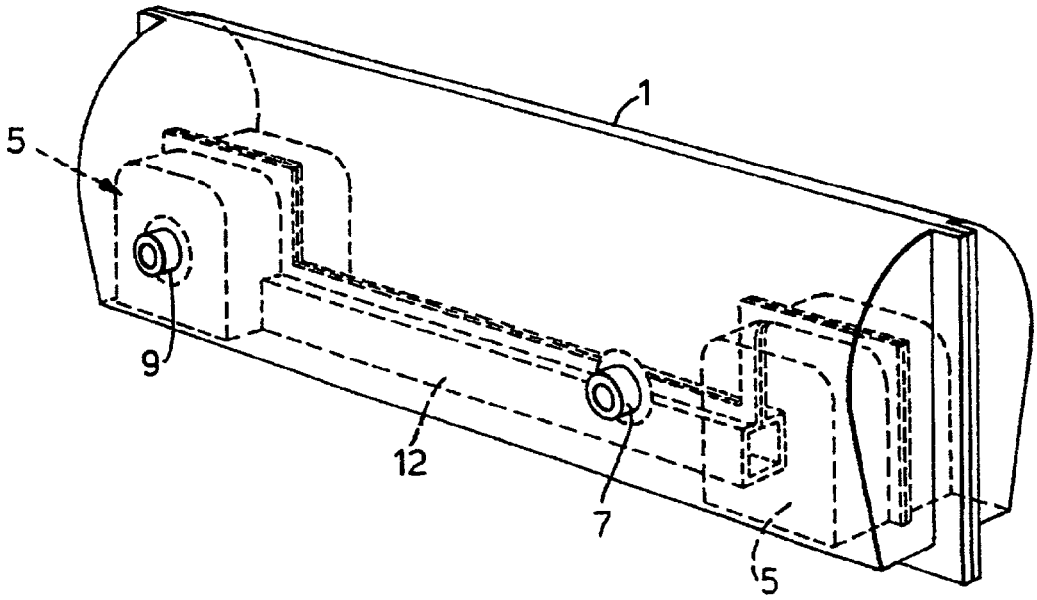
FIG. 3 is a cross-sectional representation of the pressure pad showing the internal cells and common manifold.

There is provided a base sheet 3 of plastics material to which may be attached restraining straps 4 of plastics material, each cell being retained in position by at least one such strap 4. Adjacent straps are attached to one another by welds. As shown in FIGS. 2 and 3, an internal cell 5 is attached between the sides of each cell 1 or 2 at opposite ends.

The transverse cells 1, 2 are generally tubular and of approximately constant cross-section, with height greater than width on full inflation. The internal cells 5 are positioned at about ⅔ of the height of the inflated cell 1, 2 so that the upper region of the transverse cell 1, 2 over the internal cells 5 provides pressure relief when inflated. The cross sectional shape of each internal inflated cell is preferably a rectangle with a chamfered internal upper edge. By arranging for the height of the internal cell 5 to be smaller than the transverse cell, the pressure relief is not compromised whilst also providing improved stability at the support edges. In addition, the chamfered inner edge provides a better comfortable position for the user and ensures that the area enjoying pressure relief is the whole surface of the support. The quasi-rectangular shape of each internal cell 5 is also very much more rigid than the transverse cells 1, 2.

Each transverse cell 1, 2 is made from a rectangular sheet approximately 51 cm×89 cm. A rectangular membrane measuring approximately 3.1 cm to 5 cm×86 cm is radio frequency welded to one side of the sheet so that when the sheet is folded in half along the shorter side, and welded together along the three pairs of edges, internal cells 5 having a height at about 70% of the height of the transverse cell 1, 2 are welded to the two ends.

An aperture for the passage of air from the respective feed line may be formed in each internal cell 5 and on the transverse cell 1, 2 side end.

In the preferred embodiment, the internal cells 5 are supplied with fluid by manifolds 9, 10 which run along the side of the transverse cells 1, 2. Two such manifolds are shown in FIG. 2, one manifold feeding each set of cells 1,2 and opposite internal cells 5. As shown in FIG. 3, an additional manifold 12 may be located between each internal cell 5 reducing the number of feeds to the internal cells 5. The internal cells 5 may be filled with foam rather than air to provide a firm outer edge for each transverse cell 1, 2. The two 'foam' internal cells 5 may also be interconnected with foam to prevent the patient from bottoming in the event of power failure or transportation.

The transverse cells 1,2 may be inflated alternately or constantly to provide an alternating or static support surface. The top surface of the transverse cells 1,2 may be perforated to provide a low air loss pad or mattress or seat.

The invention claimed is:

1. An inflatable support for providing pressure relief, the inflatable support comprising at least one undivided inflatable transverse cell extending transversely of the support, each at least one transverse cell having opposite ends and within each said opposite end at least one internal cell, each at least one internal cell at a higher pressure than the transverse cell and having a lower height than the transverse cell, such that the whole of an upper surface of the transverse cell provides pressure relief.

2. The inflatable support of claim 1, comprising a plurality of transverse cells, inflated and deflated alternately.

3. The inflatable support of claim 1, wherein the at least one internal cell is constantly inflated.

4. The inflatable support of claim 1, wherein the at least one internal cell is chamfered at least one internal edge.

5. An inflatable support comprising at least one inflatable transverse cell extending transversely of the support, the at least one transverse cell having outermost opposite ends and within each said outermost opposite end at least one internal cell at a higher pressure than the transverse cell, the at least one internal cell having a lower height than the transverse cell and filled with foam material.

6. An inflatable support comprising at least one undivided inflatable transverse cell extending transversely of the support, the at least one transverse cell having opposite ends and within each said opposite end at least one internal cell at a higher pressure than the transverse cell, the least one internal cell at each opposite end of the transverse cell having a lower height than the transverse cell and connected by a common manifold and inflated jointly by that manifold.

7. An inflatable support comprising at least one inflatable transverse cell extending transversely of the support, the at least one transverse cell having outermost opposite ends and within each said outermost opposite end at least one internal cell at a higher pressure than the transverse cell, the least one internal cell at each opposite end of the transverse cell having a lower height than the transverse cell and connected by a common manifold and inflated jointly by that manifold, wherein the manifold is of foam.

8. An inflatable support for providing pressure relief, the inflatable support comprising at least two sets of cells extending transversely of the support, the sets alternately inflatable and deflatable to alternately provide pressure relief and support for a patient supported on the support, each at least one transverse cell extending across a center of a width of the support and having outermost opposite ends, and within each said outermost opposite end at least one internal cell, each at least one internal cell at a higher pressure than the transverse cell and having a lower height than the transverse cell.

* * * * *